US005078639A

United States Patent [19]

Kippen

[11] Patent Number: 5,078,639

[45] Date of Patent: Jan. 7, 1992

[54] MODEL AIRCRAFT GLIDER

[76] Inventor: Stanley J. Kippen, 241 7th St., Ogden, Utah 84404

[21] Appl. No.: 562,313

[22] Filed: Aug. 3, 1990

[51] Int. Cl.[5] ..... A63H 27/00
[52] U.S. Cl. ..... 446/61; 446/34
[58] Field of Search ..... 446/61, 63, 66, 64, 446/67, 68, 34

[56] References Cited

U.S. PATENT DOCUMENTS

| | | | |
|---|---|---|---|
| D. 168,724 | 2/1953 | Anderson | 446/61 |
| D. 194,401 | 1/1963 | Tombros | 446/61 |
| 3,022,966 | 2/1962 | Briggs | 446/61 |
| 3,619,937 | 12/1969 | Thompson et al. | 446/61 |
| 3,898,763 | 8/1975 | Rizzo | 446/68 |
| 3,902,271 | 9/1975 | Turoff et al. | 446/65 |
| 4,388,777 | 6/1983 | Hermann et al. | 446/61 |
| 4,450,784 | 5/1984 | Mellinger | 446/34 |

OTHER PUBLICATIONS

"Stall-Free Glider", Popular Science, Jul. 1974, vol. 205, p. 64.

*Primary Examiner*—Robert A. Hafer
*Assistant Examiner*—David J. Kenealy
*Attorney, Agent, or Firm*—Thorpe, North & Western

[57] ABSTRACT

A one-piece, model glider craft capable of sustained flight in a glider mode in both atmospheric and underwater conditions. The glider craft comprises a delta wing structure including right and left wing sections which diverge rearward on opposite sides of a central axis from a single, forward most wing edge. A continuous leading edge extends across the front of the glider craft along the forward edge of the right wing, across the forward most wing edge and across the left leading wing edge. An elongated central body projects upward from a top surface of the delta wing structure along the central axis and is configured to provide a balanced distribution of weight. A tail fin or other vertical stabilizing structures attached at the rear part of the glider craft.

24 Claims, 2 Drawing Sheets

MODEL AIRCRAFT GLIDER

BACKGROUND OF THE INVENTION

1. Field of Invention

This invention relates to hand held, toy gliders having an aerodynamic design. More specifically, the present invention relates to a toy glider constructed of buoyant material which enables the glider to travel in a controlled path either under water or in the air.

2. Prior Art

Toy glider aircraft have always been among the most popular playthings for children. Even prior to the development of actual aircraft by the Wright brothers and their contemporaries, toy glider aircraft have intrigued both young and old.

The essential feature of glider aircraft is a light weight design which permits a floating response of the airplane once it has been launched with sufficient forward thrust. The desired lightweight properties were originally developed by hollow body construction such as illustrated in U.S. Pat. No. 1,497,774. The development of improved plastics and molding techniques spawned the generation of a new type of glider design which was injection molded or otherwise formed of lightweight plastics. An example of such construction is shown in U.S. Pat. No. 149,848. This patent introduces a delta wing design wherein the wings are swept back to reduce drag and to render a more streamlined appearance.

A further line of improvement with respect to toy glider aircraft revolves around the concerns of safety and durability. It is well known that numerous lightweight gliders formed of thin balsa wood components fly well; however, they are easily broken by impact either during flight or during landing. Furthermore, such component construction is always subject to misalignment by impact at a wing which dislodges the balanced aerodynamic configuration of the aircraft. Accordingly, one aspect of toy glider aircraft design has focused on the issue of the durability of the aircraft during flight and upon landing as well as safety within the user environment. U.S. Pat. No. 3,246,425 is illustrative of design efforts to develop a more rugged construction for glider aircraft which can survive the various impact situations which can arise during use. Such characteristics included a thickened fuselage section with blunt nose capable of absorbing impact without breaking. This patent also illustrates an additional structural aspect of reinforcing wings with tail fins which not only improve aerodynamic performance but also protect wing structure from inadvertent breakage.

The slightly earlier design is represented in U.S. Pat. No. 3,909,976 wherein the glider structure is made of foam material and includes a weighting element to give proper balance to the glider structure. The forward construction of the glider is given a large radius to reduce potential aircraft damage upon impact. It should be noted, however, that this latter aircraft is not aerodynamically configured and is more correctly classified as a "throwable" toy intended for in-house use. It is apparent from its construction that it was not intended to embody a glider having aerodynamic response such as lifting or soaring properties.

The concept of generating rounded edges is represented in U.S. Pat. No. 194,401 wherein a planar airplane design having an upright tail is disclosed. This construction is more accurately identified as a saucer craft and is not designed for gliding or soaring as our conventional toy gliders. The primary focus of this design appears to be in its survivability, regardless of the type of impact which it may undergo.

More recent aircraft design are represented in the delta wing structures represented in U.S. Pat. No. 3,898,763. This patent discloses a high performance type aircraft designed for enhanced soaring properties. It includes a nose pod which provides a fuselage to this structure and a pair of swept back wings which extend away from the nose pod. The soaring enhancement arises from a moderate reflex provided along the trailing edges of the wings in the order of 3° to 5°. This structure is blow molded with styrofoam construction and includes a wooden dowel imbedded within the nose pod to provide proper weight distribution and balance. Modified design configurations of this craft are shown in U.S. Pat. Nos. 240,437; 240,441; 240; 240,439.

Finally, U.S. Pat. No. 4,332,103 discloses another form of delta wing glider having a fuselage which extends the full length of the wing and incorporates a blunt nose for protecting the aircraft against impact damage. As with U.S. Pat. No. 3,898,763, this construction is a unibody aircraft having the advantages of avoiding dislocation of wing orientation to maintain an optimum aerodynamic state. The construction of this latter aircraft is of resilient cellular material such as foam rubber, providing resilience against breakage and an ability to mold proper wing and body configuration to enhance aerodynamic performance.

This historical review of glider aircraft demonstrates a traditional allegiance to certain design criteria which continues to dominate the current state of the art. Specifically, toy gliders generally have a nose pod or forward fuselage which provides weight and balance to the forward section of the aircraft and is designed to absorb the initial impact with trees, buildings, or the ground. this nose pod projects forward of the front leading edge of the wing or a line representing a central extension of this leading edge. Accordingly, the fuselage is of sturdy construction and generally includes some form of blunt nose projecting forward of the wing structure which is designed to absorb the impact without causing fracture or other damage to the airplane In contrast, wing structure is generally attached in a rear position along the fuselage to avoid its impact and destructive effect because its more fragile nature. This tradition is clearly represented in U.S. Pat. Nos. 3,898,763 and 4,332,103 which represent high performance model aircraft fabricated of foam rubber or styrofoam construction in a unibody form. In each instance, the nose is designed to bear the primary load of impact and the wing structure is swept back to minimize its exposure. Accordingly, a dominant design aspect for toy gliders dictates that the fuselage extend forward of the wing structure to provide protection upon impact and offer whatever balancing benefit there may be by adopting this configuration.

A further characteristic feature generally represented in all forms of toy gliders has been the absence of their adapted flight in an underwater environment. In other words, toy gliders have characteristically been designed with aerodynamic properties with performances limited to an atmospheric environment. The present inventor is unaware of any effort to configured a toy glider with fluid dynamic characteristics which enable the same glider to travel a controlled flight course whether in atmospheric conditions or under water. The absence of such design characteristics for toy gliders is somewhat surprising in view of the thousands of swimming pools which become primary playground locations for children. The development of a glider aircraft which can also be flown "underwater" is a concept which has been generously portrayed in animated video adventures; however, has been conspicuously absent in real life play.

OBJECTS AND SUMMARY OF THE INVENTION

It is an object of the present invention to provide a novel design for a unibody glider which is capable of high performance flight in an atmospheric environment, as well as underwater flight. It is a further object of the present invention to provide a toy glider craft which has greater resistance against breakage during air flight, regardless of the nature of impact or impact orientation period.

It is a further object of the present invention to provide a glider craft design which can be inexpensively molded of styrofoam or other foam plastic products, yet incorporate high performance design characteristics which enable the glider to provide a variety of aerodynamic responses during actual use.

These objects are realized in a one-piece glider craft capable of sustained flight in a glider mode both in atmospheric and underwater environments. This glider craft includes a delta wing structure including right and left wing sections which diverge rearward on opposite sides of a central axis from a single, forward most wing edge in a swept back manner. This delta wing includes right and left leading wing edges which join with the forward most wing edge to form a continuous leading edge extending across the front of the glide craft. An elongated central body projects upward from a top surface of the delta wing structure along the central axis. The central body is configured to provide a balanced distribution of weight for enhancing aerodynamic stability during flight. The configuration is generally larger in size at a forward part of the glide craft and tapers to a smaller size progressively to a rearward part. Tail fin structure is attached at the rearward part of the aircraft for stabilizing its glide path along the forward flight trajectory. Specific design features are further represented for enhancing the durability and performance of the glide craft.

Other objects and features of the present invention will be apparent to those skilled in the art and technique in view of the following detail description, taken in combination with the accompanying drawings.

DETAILED DESCRIPTION OF THE INVENTION

Figure 1:
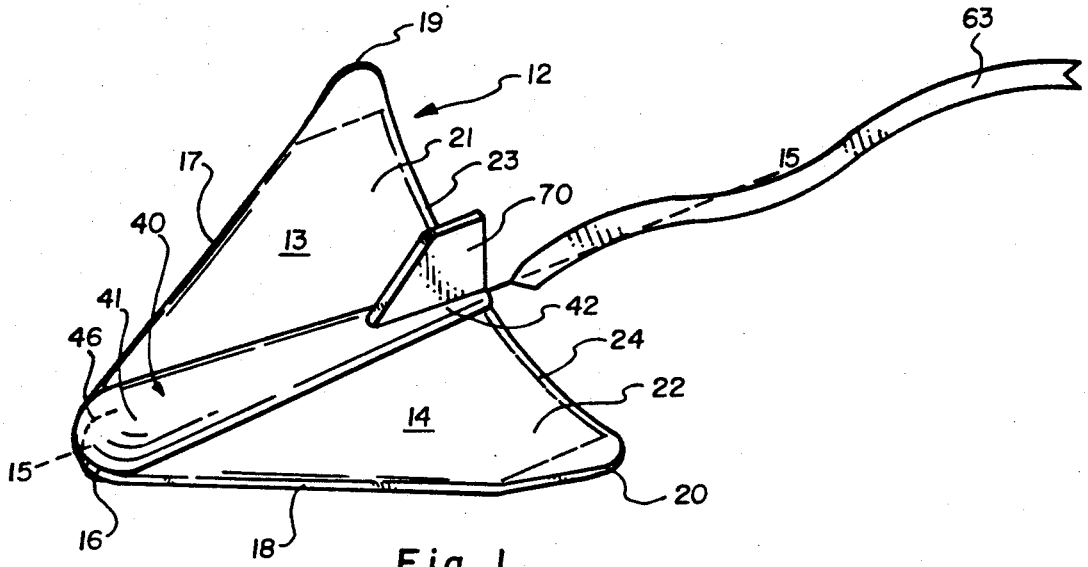
FIG. 1 shows a perspective view of one embodiment of a glide craft constructed in accordance with the present invention.

Referring now to the drawings:

A model glider craft 12 is illustrated in FIG. 1. This craft is of one piece construction and may be fabricated by injection or blow molding using styrofoam or other comparable materials to provide a low density, buoyant construction which is resilient to impacts which typically occur with toy glider aircraft. Because of the unique structural design of the present invention, it is capable of enduring the strong forces which occur in submerged or underwater applications as well. For example, even the very act of lowering the styrofoam aircraft within the water creates buoyant forces which apply significant loads on the fragile wing structure which could otherwise break the aircraft in parts. The unique triangular structure of the present invention preserves the aircraft despite being submersed to depths greater than ten feet under the water. Upon release, this glider craft cuts through the water at a gradual climb, traveling ten to thirty feet, depending upon the depth of submersion. If released in an inverted mode, its distance of travel is even greater.

Similarly, in atmospheric flight conditions, the subject invention performs as a high performance type glider. The unique aerodynamic properties permit the user to float the aircraft in both windy and non windy conditions and develop great accuracy in repetitive launching with predictable trajectories. In other words, the subject aircraft can be used to play "catch" in that two persons can throw the invention back and forth with predictable accuracy. Nevertheless, by modified throwing patterns, a single person can launch the aircraft so that it returns or develops other trajectories of interest. The present inventor is unaware of any other toy glider crafts which has high performance characteristics in atmospheric conditions, as well as the ability to be useful in underwater environments as a submersible glider toy.

These surprising and distinguishable performance characteristics in such contrasting environments of air versus water are enabled by a unique delta wing structure which includes right 13 and left 14 wing sections diverging rearward on opposite sides of a central axis 15. The respective right and left wing sections extend rearward in a swept-back configuration from a single, forward most wing edge 16 which forms a gradual arc connecting the right and left leading wing edges 17 and 18. It should be noted that the forward most wing edge 16 and the respective right and left leading wing edges 17 and 18 form a continuous leading edge extending across the front of the glider craft from each respective wing tip 19 and 20 and that no projecting nose structure extends forward of the gradual arc of the forward leading edge 16.

The delta wing structure further includes a rearward wing section 21 and 22 with a trailing wing edge 23 and 24. This rearward wing structure and trailing edge provide a gradually tapering thickness as compared to a thicker front portion of the delta wing structure at the forward half of the glider craft. Indeed, part of the strength which permits use of this glider craft both in underwater and atmospheric environments is its structural design which is characterized by a thick wing structure along a front half of the delta wing body.

For example, whereas the trailing edges 21 and 22 may be from ⅛" to ¼" in thickness, the forward half of the delta wing structure is between ½" to 1" in thickness. This thickness increases toward the center part of the delta wing structure and tapers gradually toward the continuous leading edge 16, 17 and 18. The continuous leading edge in the forward part of the delta wing structure is approximately half the thickness of the central portion of the delta wing structure. Accordingly, much of the strength of this glider craft arises from the thickness of the forward half of the delta wings structure. This is also the region most vulnerable to impacts with trees, buildings and other objects in atmospheric flight conditions, and incurs most of the loading in submerged use.

This greater thickness of ½" to 1" along the forward half of the delta wing structure is contrasted with the reduced thickness of the delta wing structure along the rearward half of the glider craft. This part of the wing tapers to a very thin thickness of less than ⅛" at the trailing wing edge 23 and 24. This trailing wing edge also includes a reflex airfoil design 25 and 26 (FIG. 5) which turns upward at an underside the trailing wing edge. This reflex design enhances the airflow speed and controls downwash. The degree of reflex operates to preset the trim position of the craft.

Figure 3:
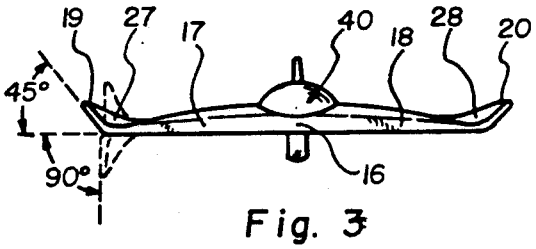
FIG. 3 illustrates a front plan view of the glide craft to FIG. 1.

The opposing distal ends 19 and 20 of the respective right and left wing sections 13 and 14 have wing tips which are angled upward at approximately equal angles of inclination within the range of 10° to 60°. The preferred embodiment is designed with an angle of inclination of approximately 45° as illustrated in FIG. 3. It will be noted that the inclination of these distal ends 19 and 20 provides an exposed, flaired surface 27 and 28 which enhances the glide performance and lift for the delta wing structure as well as improving flight stability.

Figure 4:
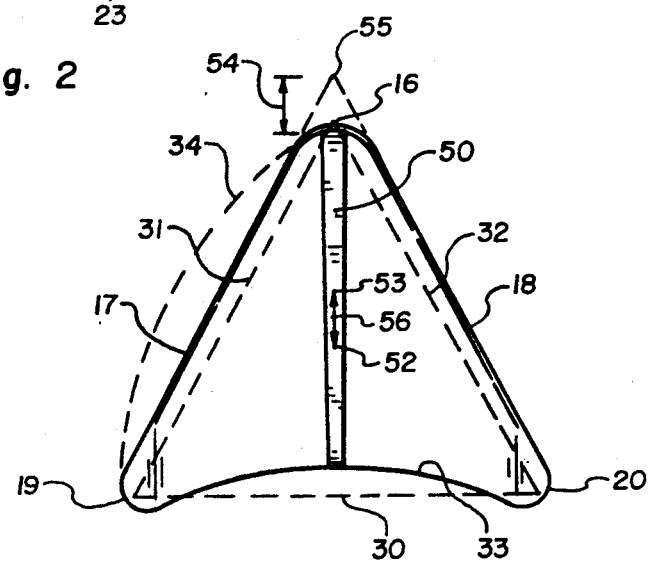
FIG. 4 shows a bottom plan view of the glide craft illustrated in FIG. 1.

An additional feature of the most preferred embodiment is its geometric configuration in approximate shape of an equilateral triangle as illustrated in FIG. 4 by the dashed lines 30, 31 and 32. This triangle is formed by connection of the distal ends on the respective right 19 and left 20 wings and the forward most point on the nose of the glider craft at leading edge 16. This equilateral triangle configuration not only offers enhanced durability because of the symmetry of the craft which minimizes the number of weak points in the craft structure, but offers surprisingly improved aerodynamic performance. Additional symmetry and enhancement to performance is provided when the trailing edge 23 and 24 is modified as shown in FIG. 4 such that the modified trailing edge 33 comprises an arch whose radius is approximately equal to the side length of any of sides 30, 31 and 32. The arch formed by such a radius 34 is the same arch configuration existing in modified trailing edge 33. It would be apparent that these preferred configurations are not to be construed as limiting. One skilled in the art will readily note that other geometries may be applied to the delta wing structure without disturbing its primary characteristics of thickness, weight distribution and continuous leading edge for a delta wing structure.

Correct balance to the delta wing structure is provided by an elongated central body 40 which projects upward from a top surface of the delta wing structure along the central axis 15. This central body is configured in tapering form to provide a balanced distribution of weight for providing aerodynamic stability to the glider craft during flight. This configuration is generally larger in size at a forward part of the glider craft 41, tapering to a smaller size progressively toward a rearward part of the glider craft 42.

Figure 2:
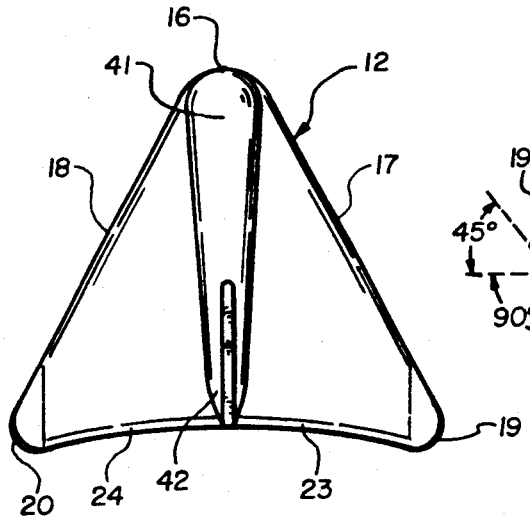
FIG. 2 shows a top plan view of the glide craft of FIG. 1.
Figure 5:
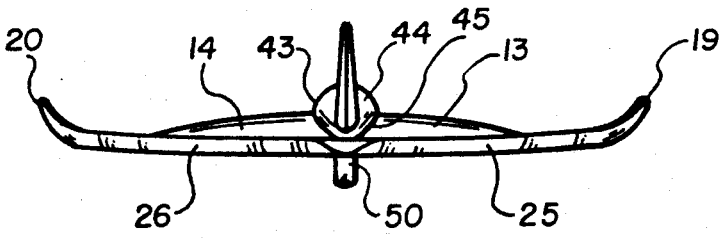
FIG. 5 shows a rear view of the glider craft illustrated in FIG. 1.
Figure 6:
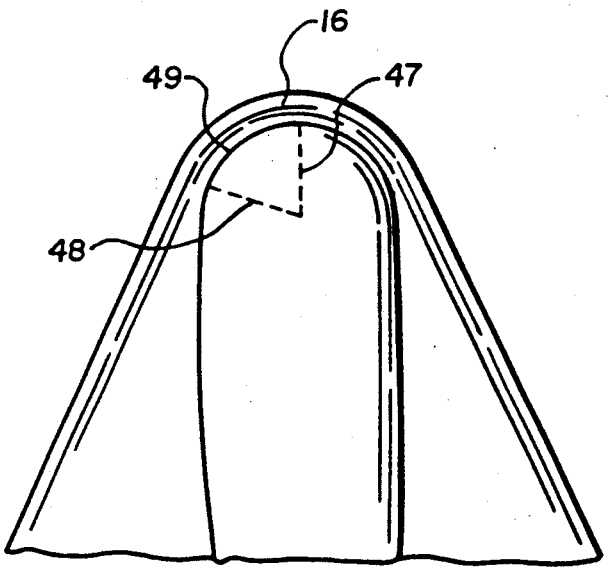
FIG. 6 shows a top plan view of the nose and forward wing edge structure of the glide craft.
Figure 7:
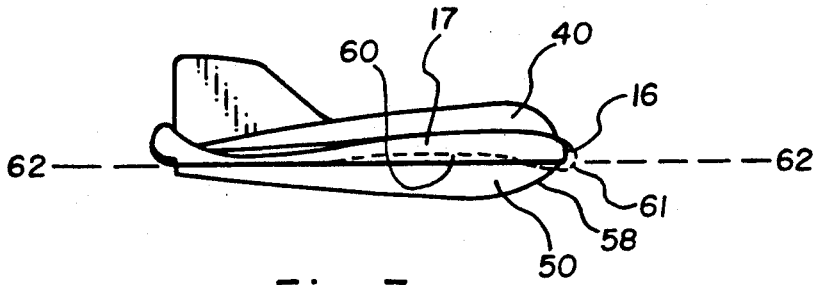
FIG. 7 illustrates a side plan view of the glider craft shown in FIG. 1.

As is illustrated in FIG. 5, the elongated central body has an approximate arcuate, cross sectional shape 43 which extends upward from distal ends of the arcuate cross section which join at the top surface of the delta wing structure 45. The front end of the central body extends forward to form a nose section which has a tapering structure forming a rounded nose 46 which joins at the forward most wing edge 16. This nose section can be generally described as quarter sphere (flattened at its top surface) with a generally uniform radius along any horizontal plane, as represented by radii 47 and 48 (FIG. 6 which are drawn at the juncture of the central body to the wing surface). In its preferred embodiment, the forward edge of the rounded nose 49 merges with the forward most wing edge 16 to form a frontal impact section void of sharp points and other projecting structure which could flip the glider craft on impact. This construction also incorporates a preferred feature of the forward most wing edge 16 wherein this edge 16 comprises an arc formed with a uniform horizontal radius. The continuation of the continuous leading edge 17 and 18 from this forward most wing arc 16 may be a straight line as shown in FIGS. 1 and 2, or may incorporate an arc as illustrated by the broken line 34 FIG. 4. The use of an arc configuration along the right and left leading edges of the delta wing structure enhances the ability of the glider craft to fly in a loop and return to the user. In this configuration, the right and left leading wing edges form a convex arch which projects forward from the delta wing structure.

An additional enhancement on the present invention comprises a lower body extension 50 which projects downward under the delta wing structure below the central body 40. This lower body extension is configured with an approximate uniform width for improving stability in flight and has a geometric configuration which maintains an aerodynamic weight distribution for the glider craft.

It has generally been determined that the preferred weight distribution for the subject glider craft occurs when the center of gravity is approximately at the geometric center of the equal lateral triangle as illustrated in FIG. 4. This point is represented by 52 and represents the equilateral triangle having sides 31 and 32. A forward limit for the preferred center of mass is illustrated at 53 which is the distance between the nose 16 of the glider craft and the distance 17 distance 54 to the apex 55 of the triangle formed by the extension of front edges 17 and 18. Accordingly, the preferred center of mass would exist somewhere along line 56 mounted by points 52 and 53.

It is to be understood that the glider craft will work with a center of mass applied outside limiting points 52 and 53; however, its vesatility in both water and air would be limited. By having the center of mass along this line, the buoyancy from the aircraft under water tends to lift uniformly, avoiding a sudden straight shot or spurt of the aircraft to the surface. Instead, this balanced weight distribution tends to maintain the buoyant aircraft in a somewhat flat trejectory, allowing the air foil design to operate at a stabilizing factor as the glider craft soars throuhg the water in a somewhat inclined path.

Proper balancing of the glider craft is established by both the central body 40 and the lower body extension 50. As can be seen from the drawings, most of the distributing weight load is provided at the upper surface of the delta wing by the central body. Approximately one-third of the additional weight load is supplied by the lower body extension 50. Although this fraction is not critical, the incorporation of a lower body extension approximately within this range offers not only an improved handle by which the user may grasp the airplane for launching, but also provides a skid runner which protects the aircraft upon landing. With a reduced length along an arcuate path as shown at 58, the front of the aircraft is well protected by rounded edges (i horizontally across the forward most wing edge 16 and ii vertically across the rounded nose 46 and rounded lower body extension 58. Regardless of the fractional part of the additional weight offered by the skid runner, the design criteria remain the same. Specifically, the lower body extension should have sufficient width, heighth and durability on impact to survive and protect the aircraft from contact with the ground or other impacting objects. In addition, the skid runner provides additional stability in flight by operating it as a rudder.

A final component of structure for the glider craft is a tail fin means 70 which is coupled to the central body 40 at a rearward section thereof. This tail fin complements the flaired distal wing sections 19 and 20 for providing stability in flight. The single fin structure 70 could also be applied as separate fins on other portions of the upper delta wing surface in accordance with well known teachings.

It will be apparent to those skilled in the art that the preferred embodiments disclosed herein are meant only as examples of the inventive concepts disclosed. Numerous other geometries and configurations may be adopted to implement the inventive concepts disclosed and claimed hereafter. For example, each of the right and left wing sections may be modified to include central regions 60 which are slightly recessed in a gradual, arcuate configuration over approximately over one-third of the underwing surface area. Such recessed structure enhances the properties of the glider craft and appears to offer some improvement and stability. In addition, the forward most wing edge 16 may be modified to develop a slight downward extension or dip 61 below a plane 62 containing most of the lower wing surface. This forward 62 containing most of the lower wing surface. This forward most edge in the downward extension configuration is developed by simply configuring the forward wing structure so that it gradually curves downward in a uniform manner across the forward, lower surface of the wing structure. Finally, add-on features are contemplated, such as a streamer 63 which is attached at a rearward location of the central body 40. This not only offers additional visual excitement as with a jet stream behind the glider, but also assists in locating the glider after landing. The amount of drag applied by the streamer must be balanced with respect to the other aerodynamic properties of the glider craft.

In view of the foregoing it is to be understood, the subject matter of this invention is defined by the following claims, and is not limited by specific examples set forth herein.

I claim:

1. A one-piece, model glider craft capable of sustained flight in a glide mode in both atmospheric and underwater environments, said glider craft comprising:

a) a delta wing structure including a forwardmost wing edge of gradual arcing configuration representing a nose section of the craft and right and left wing sections diverging tangentially from said forwardmost arc and substantially linearly rearward on opposite sides of the forwardmost wing edge in swept back manner to form right and left leading wing edges, said forwardmost wing edge forming a gradual connecting arc between said right and left leading wing edges and joining collectively to form a continuous leading edge extending across the front of the glider craft which has no projecting nose structure forward of the gradual arc;

b) an elongated central body projecting upward from a top surface of the delta wing structure along the central axis, said central body being configuration to provide a balanced distribution of weight for providing aerodynamic stability to the glider craft during flight, said configuration being generally larger in size at a forward part of the glider craft to absorb impact energy and tapering to a smaller size progressively toward a rearward part of the glider craft;

c) tail fin means attached at the rearward part of the glider craft for stabilizing the glider craft in flight.

2. A model glider craft as defined in claim 1, wherein the delta wing structure further includes a rearward wing section with a trailing wing edge having a tapering thickness.

3. A model glider craft as defined in claim 1, wherein the elongated central body has an approximate arcuate crosssection slightly flattened at the top and extending upward from distal ends of the arcuate cross-section which join at the top surface of the delta wing structure.

4. A model glider craft as defined in claim 3, wherein said arcuate central body extends forward to form a nose section which has a tapering structure forming a rounded nose joined proximate to the forwardmost wing edge.

5. A model glider craft as defined in claim 4, wherein the rounded nose is approximately configured as-a quarter sphere with a generally uniform radius along any horizontal plane.

6. A model glider craft as defined in claim 5, wherein a forward edge of the rounded nose and the forwardmost wing edge merge to form a frontal impact section void of sharp points and other projecting structure which could flip the glider craft on impact.

7. A model glider craft as defined in claim 1, wherein opposing distal ends of the respective right and left wing sections have wing tips that are angled upward at equal angles of inclination within the range of 10 to 60 degrees.

8. A model glider craft as defined in claim 1, wherein the forward leading edges of each wing are approximately equal in distance to the separation distance between distal ends of each wing.

9. A model glider craft as defined in claim 2, wherein the trailing wing edge is configured as a concave arc whose radius is approximately equal to the length of the respective leading edges of the right and left wing structure.

10. A model glider craft as defined in claim 9, wherein the trailing wing edge includes a reflex airfoil design which turns upward at an under side of the trailing wing edge.

11. A model glider craft as defined in claim 1, further comprising a lower body extension projecting downward under the delta wing structure below the central body and configured with a uniform width for improving stability in flight and having a geometric configuration which maintains an aerodynamic weight distribution for the glider craft.

12. A model glider craft as defined in claim 11, wherein distance of downward projection of the lower body extension is gradually reduced forward and rearward from its center of gravity, providing an optimum handle structure for a user to grasp the glider craft for launching purposes and for enhancing flight performance in both atmospheric and underwater environments.

13. A model glider craft as defined in claim 12, wherein the lower body extension is configured with sufficient width, height and durability on impact to form a skid runner suitable for use as a landing base.

14. A model glider craft as defined in claim 1, wherein central regions under each of the right and left wing sections are slightly recessed in a gradual arcuate configuration over approximately one third of the underwing surface area to enhance lift properties of the glider craft.

15. A model glider craft as defined in claim 1, further comprising a streamer attached at a central portion of the trailing wing edge.

16. A model glider craft as defined in claim 1, wherein the forwardmost wing edge dips slightly below a plane containing most of the lower wing surface of the delta wing structure, the forwardmost edge being formed by forward wing structure which gradually curves downward from the lower wing surface.

17. A model glider craft as defined in claim 7, wherein the angle of inclination of the distal wing tips is within a range of zero to plus or minus 90 degrees.

18. A model glider craft as defined in claim 1, wherein the forwardmost wing edge is an arc formed with a uniform radius along the continuous leading edge and the right and left leading wing edges form a substantially straight line extending rearward from terminal ends of the arc.

19. A one-piece, model glider craft capable of sustained flight in a glider mode in both atmospheric and underwater environments, said glider craft comprising:

a) a delta wing structure having a central axis and including right and left wing sections diverging substantially linearly and tangentially from opposite sides of a central, forwardmost wing arc in swept back manner to form right and left leading wing edges, said forwardmost wing arc and said right and left leading wing edges forming a continuous leading edge extending across the front of the glider craft;

b) an elongated central body projecting upward from a top surface of the delta wing structure along the central axis, said central body being configured to provide a balanced distribution of weight for providing aerodynamic stability to the glider craft during flight, said configuration being generally larger in size at a forward part of the glider craft to absorb impact energy and tapering to a smaller size progressively toward a rearward part of the glider craft;

c) tail fin means attached at the rearward part of the glider craft for stabilizing the glider craft in flight;

d) wherein the elongated central body has an approximate arcuate cross section slightly flattened at the top and extending upward from distal ends of the arcuate cross section which join at the top surface of the delta wing structure;

said arcuate central body extending forward to form a nose section which has a tapering structure forming a rounded nose joined approximate to the forwardmost wing edge;

wherein the rounded nose is approximately configured as a quarter sphere with a generally uniform radius along any horizontal plane.

20. A model glider craft as defined in claim 19, wherein a forward edge of the rounded nose and the forwardmost wing arc merge to form a frontal impact section void of sharp points and other projecting structure which could flip the glider craft on impact.

21. A one-piece, model glider craft capable of sustained flight in a glider mode in both atmospheric and underwater environments, said glider craft comprising:

a) a delta wing structure having a central axis and including right and left wing sections diverging substantially linearly rearward and tangentially from opposite sides of a central forwardmost wing arc in swept back manner to form right and left leading wing edges, said forwardmost wing arc and said right and left leading wing edges forming a continuous leading edge extending across the front of the glider craft;

b) an elongated central body projecting upward from a top surface of the delta wing structure along the central axis, said central body being configured to provide a balanced distribution of weight for providing aerodynamic stability to the glider craft during flight, said configuration being generally larger in size at a forward part of the glider craft to absorb impact energy and tapering to a smaller size progressively toward a rearward part of the glider craft;

c) tail fin means attached at the rearward part of the glider craft for stabilizing the glider craft in flight;

d) wherein the delta wing structure further includes a rearward wing section with a trailing wing edge having a tapering thickness;

e) wherein the trailing wing edge is configured as a concave arc whose radius is approximately equal to the length of the respective leading edges of the right and left wing structure.

22. A model glider craft as defined in claim 21, wherein the trailing wing edge includes a reflex airfoil design which turns upward at an under side of the trailing wing edge.

23. A one-piece, model glider craft capable of sustained flight in a glider mode in both atmospheric and underwater environments, said glider craft comprising:

a) a delta wing structure having a central axis and including right and left wing sections diverging substantially linearly rearward and tangentially from opposite sides of a central, forwardmost wing arc in swept back manner to form right and left leading wing edges, said forwardmost wing arc and said right and left leading wing edges forming a continuous leading edge extending across the front of the glider craft;

b) an elongated central body projecting upward from a top surface of the delta wing structure along the central axis, said central body being configured to provide a balanced distribution of weight for providing aerodynamic stability to the glider craft during flight, said configuration being generally larger in size at a forward part of the glider craft to absorb impact energy and tapering to a smaller size progressively toward a rearward part of the glider craft;

c) tail fin means attached at the rearward part of the glider craft for stabilizing the glider craft in flight;

d) further comprising a lower body extension projecting downward under the delta wing structure below the central body and configured with a uniform width for improving stability in flight and having a geometric configuration which maintains an aerodynamic weight distribution for the glider craft;

e) wherein the distance of downward projection of the lower body extension is gradually reduced down through underwater environments; and f) wherein the lower body extension is configured with sufficient width, height and durability on impact to form a skid runner suitable for use as a landing base.

24. A one-piece, model glider craft capable of sustained flight in a glider mode in both atmospheric and underwater environments, said glider craft comprising:

a) a delta wing structure having a central axis and including right and left wing sections diverging substantially linearly rearward and tangentially from opposite sides of a central forwardmost wing arc in swept back manner to form right and left leading wing edges, said forwardmost wing arc and said right and left leading wing edges forming a continuous leading edge extending across the front of the glider craft;

b) an elongated central body projecting upward from a top surface of the delta wing structure along the central axis, said central body being configured to provide a balanced distribution of weight for providing aerodynamic stability to the glider craft during flight, said configuration being generally larger in size at a forward part of the glider craft to absorb impact energy and tapering to a smaller size progressively toward a rearward part of the glider craft;

c) tail fin means attached at the rearward part of the glider craft for stabilizing the glider craft in flight;

d) wherein the forwardmost wing edge dips slightly below a plane containing most of the lower wing surface of the delta wing structure, the forwardmost arc being formed by forward wing structure which gradually curves downward from the lower wing surface.

* * * * *